US008405696B2

(12) United States Patent
Yahata et al.

(10) Patent No.: US 8,405,696 B2
(45) Date of Patent: Mar. 26, 2013

(54) PRINTING SHEET REUSABILITY DETERMINATION DEVICE, ERASING DEVICE, IMAGE FORMING DEVICE, AND PRINTING SHEET REUSABILITY DETERMINATION METHOD

(75) Inventors: Isao Yahata, Shizuoka-ken (JP); Hiroyuki Tsuchihashi, Shizuoka-ken (JP); Ken Iguchi, Shizuoka-ken (JP); Takahiro Kawaguchi, Shizuoka-ken (JP); Hiroyuki Taguchi, Shizuoka-ken (JP); Hiroyuki Taki, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 196 days.

(21) Appl. No.: 13/042,412

(22) Filed: Mar. 7, 2011

(65) Prior Publication Data

US 2011/0221852 A1 Sep. 15, 2011

Related U.S. Application Data

(60) Provisional application No. 61/312,065, filed on Mar. 9, 2010, provisional application No. 61/312,059, filed on Mar. 9, 2010.

(51) Int. Cl.
*B41J 29/16* (2006.01)

(52) U.S. Cl. ..... 347/179

(58) Field of Classification Search ..... 347/171, 347/179, 223, 104, 105; 400/120.01; 399/4, 399/186; 250/316.1, 317.1
See application file for complete search history.

(56) References Cited

U.S. PATENT DOCUMENTS 5,683,189 A * 11/1997 Sukigara et al. ..... 347/179
6,152,620 A * 11/2000 Ozawa et al. ..... 347/179
6,860,658 B2 * 3/2005 Tischer ..... 347/179

* cited by examiner

*Primary Examiner* — Kristal Feggins
(74) *Attorney, Agent, or Firm* — Patterson & Sheridan, LLP

(57) ABSTRACT

A printing sheet reusability determination device includes a sheet carrying path that carries a second state sheet obtained by erasing an erasable image from a first state sheet on which the erasable image is printed, an imaging portion that images the second state sheet on the sheet carrying path, an illumination portion that illuminates the second state sheet on the sheet carrying path at a first irradiation angle when images remaining on the second state sheet are photographed, and at a second irradiation angle smaller than the first irradiation angle when a projected image generated by illuminating the second state sheet is photographed, an irradiation angle changing portion that changes the first irradiation angle and the second irradiation angle, and a reusability determination portion that determines whether or not to reuse the second state sheet based on imaging information obtained by the imaging of the imaging portion at the first irradiation angle and determines whether or not to reuse the second state sheet based on imaging information obtained by the imaging of the imaging portion at the second irradiation angle.

19 Claims, 7 Drawing Sheets

PRINTING SHEET REUSABILITY DETERMINATION DEVICE, ERASING DEVICE, IMAGE FORMING DEVICE, AND PRINTING SHEET REUSABILITY DETERMINATION METHOD

CROSS-REFERENCE TO RELATED APPLICATION

This application is based upon and claims the benefit of priority from: U.S. provisional application 61/312,065, filed on Mar. 9, 2010; 61/312,059, filed on Mar. 9, 2010, the entire contents of all of which are incorporated herein by reference.

FIELD

Embodiments described herein relate generally to a technique of determining reusability of a sheet from which an erasable image is erased.

BACKGROUND

There is provided an erasing technique capable of erasing an erasable image printed on a sheet by heating. By this erasing technique, a sheet can be reused by erasing an erasable image on the sheet.

A sheet (hereinafter, referred to as an "erased sheet") for which the erasing process is completed by erasing an erasable image in an erasing device which erases the erasable image is reused in a printer or the like, and thus it is necessary to detect presence or absence of residues after erasure in advance.

In addition, the erased sheet is different from an unused sheet, thus appearance defects such as wrinkles occur, and when reused, it is necessary to detect such an appearance defect in advance.

In the erasing device, if a printing image erasing unit which erases an erasable image and a stacking portion which stacks the erased sheets thereon are integrally formed, the erased sheets can be automatically stacked in the stacking unit.

In such a case, if residual images on the erased sheet and the appearance defect of the erased sheet can be automatically detected and then whether or not to reuse the sheet can be determined, the erased sheets stacked in the stacking portion can be reused without concern. If the erased sheets can be sorted according to their sizes in the stacking portion, the stacked erased sheets can be easily treated.

In addition, in a case where the erased sheet is used in an image forming device such as a printer, if whether or not to reuse the sheets can be determined using functions of a corresponding image forming device before a plurality of erased sheets are contained in a paper feeding cassette or the like, the erased sheets can be reused without concern.

DETAILED DESCRIPTION

Figure 1:
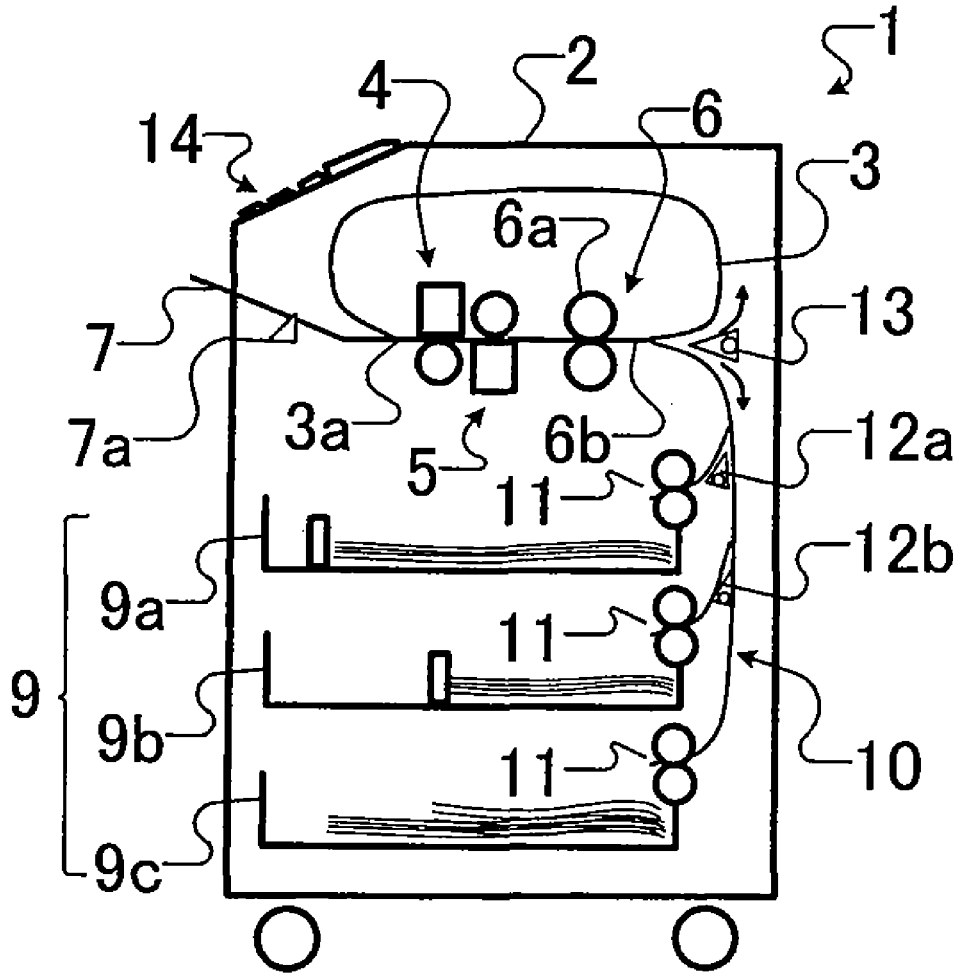
FIG. 1 is the overall configuration diagram illustrating an erasing device according to an embodiment.

According to one embodiment, there is provided a printing sheet reusability determination device including a sheet carrying path that carries a second state sheet obtained by erasing an erasable image from a first state sheet on which the erasable image is printed; an imaging portion that images the second state sheet on the sheet carrying path; an illumination portion that illuminates the second state sheet on the sheet carrying path at a first irradiation angle when images remaining on the second state sheet are photographed, and at a second irradiation angle smaller than the first irradiation angle when a projected image generated by illuminating the second state sheet is photographed; an irradiation angle changing portion that changes the first irradiation angle and the second irradiation angle; and a reusability determination portion that determines whether or not to reuse the second state sheet based on imaging information obtained by the imaging of the imaging portion at the first irradiation angle and determines whether or not to reuse the second state sheet based on imaging information obtained by the imaging of the imaging portion at the second irradiation angle.

According to one embodiment, there is provided an printing sheet erasing device including a sheet carrying path that carries a first state sheet on which an erasable image is printed; a printing image erasing portion that erases the erasable image on the first state sheet which is carried on the sheet carrying path; a reading portion that applies illumination light to a surface of a second state sheet obtained by erasing the erasable image from the first state sheet in the printing image erasing portion, in an irradiation state where a projected image is easy to generate and in an irradiation state where the projected image is difficult to generate, and that reads a surface of the second state sheet for each irradiation state using the imaging unit; and a reusability determination portion that determines whether or not to reuse the second state sheet based on an imaging result from the imaging portion according to the irradiation states of the illumination light.

According to one embodiment, there is provided an image forming device which reads an original document sent from an automatic document feeder using a scanner portion, and can change an image forming mode in which an image is formed on a sheet based on information for an image read by the scanner portion and a reusability determination mode in which a second state sheet on which an erasable image is erased from a first state sheet on which the erasable image is printed is determined for reusability, including a reusability determination portion that determines whether or not to reuse the second state sheet based on read information for the second state sheet which is read by the scanner portion when the reusability determination mode is selected.

Hereinafter, a printing sheet reusability determination device, an erasing device, and an image forming device related to embodiments will be described in detail with reference to the accompanying drawings.

Figure 2:
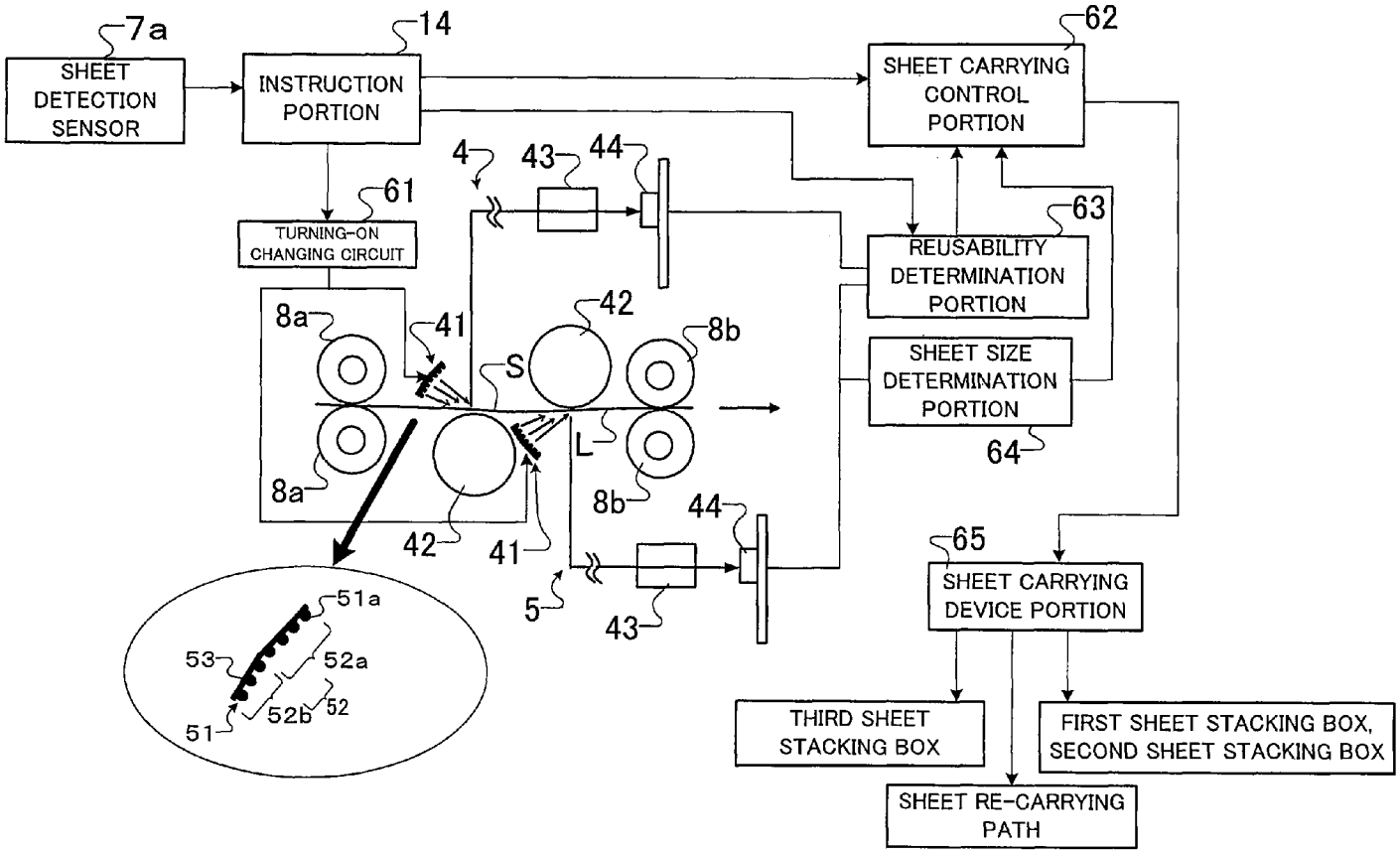
FIG. 2 is a diagram illustrating a structure and a control block of a reusability determination portion according to a first embodiment provided in the erasing device in FIG. 1.
Figure 3:
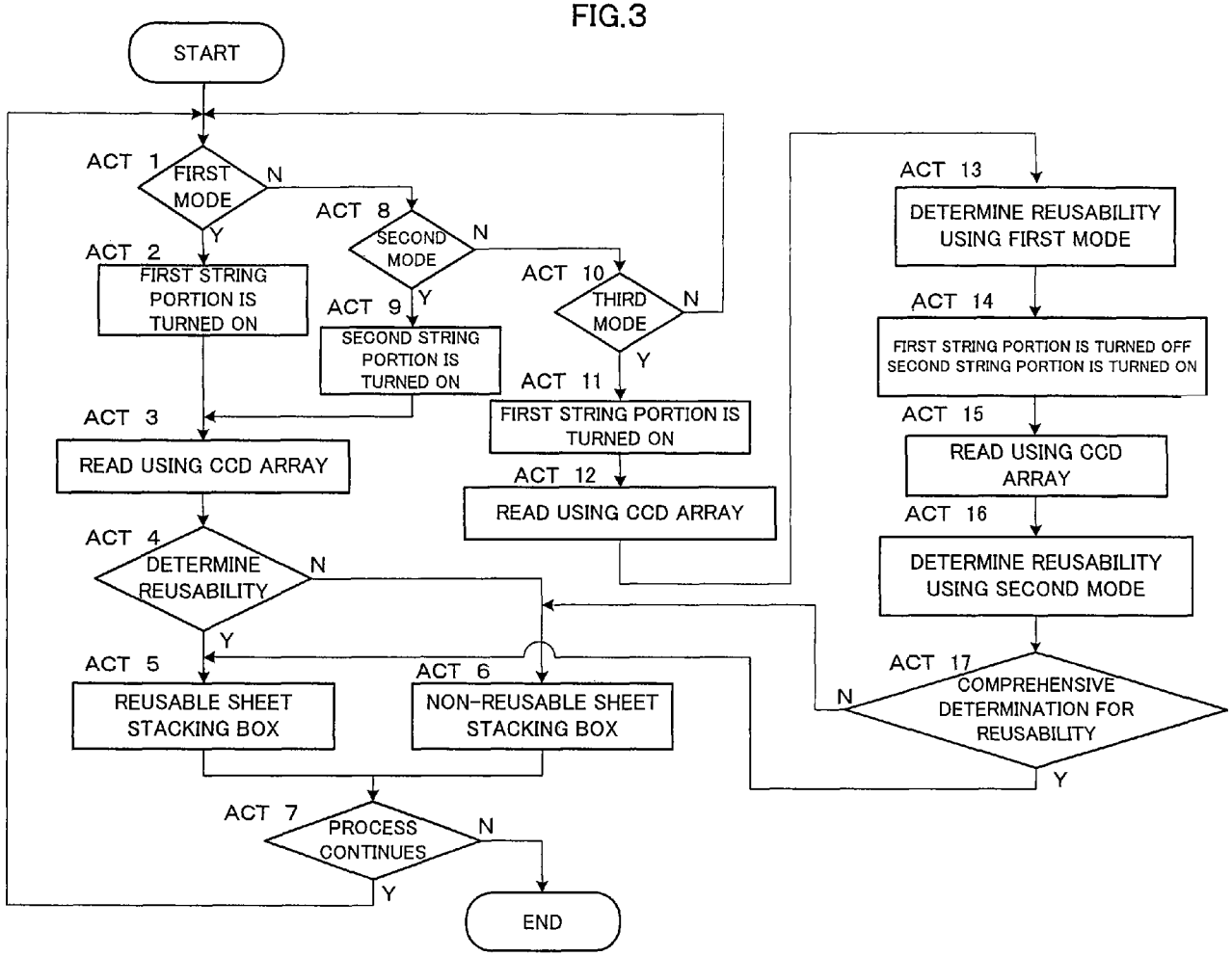
FIG. 3 is a flowchart illustrating an operation in the control block in FIG. 2.

FIG. 1 is the overall configuration diagram illustrating an erasing device including a reusability determination device according to an embodiment; FIG. 2 is a diagram illustrating a structure and a control block of a reusability determination portion according to a first embodiment provided in the erasing device in FIG. 1; and FIG. 3 is a flowchart illustrating an operation in the control block in FIG. 2.

An erasing device 1 shown in FIG. 1 has an endless sheet re-carrying path 3 in the upper part of a case 2, and a first reading portion 4, a second reading portion 5, and a printing image erasing portion 6 are sequentially disposed from the upstream side to the downstream side in the carrying direction in a lower horizontal carrying portion 3*a*.

The printing image erasing portion 6 includes a pair of upper and lower heating rollers 6*a* and 6*b*, and an erasable image is erased when a non-erased sheet passes through a nip portion between a pair of heating roller 6*a* and 6*b*. In this embodiment, erasable images on both sides of the non-erased sheet are simultaneously erased.

A bypass tray 7 which stacks therein a sheet on which an erasable image is printed (hereinafter, referred to as a "non-erased sheet") is provided in the front side of the case 2. The front end of the bypass tray 7 is disposed at the upstream side of the horizontal carrying portion 3*a*, and a non-erased sheet stacked in the bypass tray 7 is intermittently fed to a pair of pre-carrying rollers 8*a* shown in FIG. 2 by paper feeding roller pair (not shown). In addition, the bypass tray 7 is provided with a sheet detection sensor 7*a* and transmits a signal indicating whether or not a sheet is present to an instruction portion 14 shown in FIG. 2. If a signal indicating that a sheet is present is output from the sheet detection sensor 7*a*, for example, consecutive erasing is performed.

A pair of post-carrying rollers 8*b* which receives a sheet carried by the pre-carrying rollers 8*a* is disposed between the second reading portion 5 and the printing image erasing portion 6 as shown in FIG. 2. Further, the sheet is carried to the heating roller pair 6*a* and 6*b* of the printing image erasing portion 6 by the post-carrying rollers 8*b*.

In addition, a flapper 13 which changes carrying directions is disposed so as to face to the carrying end of the horizontal carrying portion 3*a*. Due to changing by the flapper 13, a sheet (referred to as an "undetermined sheet") which does not undergo a reusability determination, described later, of erased sheets is carried towards the sheet re-carrying path 3, and a sheet (referred to as a "determined sheet") undergoes the reusability determination of the erased sheets is carried towards a sheet carrying portion 10 described later.

For the undetermined sheet re-carried by the sheet re-carrying path 3, both front and rear sides thereof are read by the first reading portion 4 and the second reading portion 5 at the same time.

In this embodiment, the first reading portion 4 and the second reading portion 5 independently perform the detection of residual images on the erased sheet and the detection of the appearance defects on the erased sheet by making irradiation states such as irradiation angles of illumination light which applies light to a sheet, be different. For this reason, for example, after the detection of residual images is completed, the appearance defects on the erased sheet are detected by changing the irradiation angle of the illumination light while once again passing the sheet carrying portion 10. In addition, whether or not to reuse the erased sheet is determined based on the detection result of residual images on the erased sheet and the detection result of appearance defects on the erased sheet.

In this embodiment, the first reading portion 4 reads the front surface which is a first surface of the erased sheet, and the second reading portion 5 reads the rear surface which is a second surface of the erased sheet along with the first surface.

Next, a sheet stacking portion 9 which stacks determined sheets of the erased sheets thereon is disposed under the sheet re-carrying path 3. In this embodiment, the sheet stacking portion 9 includes a plurality of sheet stacking boxes 9*a*, 9*b* and 9*c* arranged longitudinally, and each sheet stacking box is extracted from the case 2.

The uppermost first sheet stacking box 9*a* stacks therein determined sheets of, for example, size A3 which are determined as being reusable, and the middle second sheet stacking box 9*b* stacks therein determined sheets of, for example, the size A4 which are determined as being reusable. The lowermost third sheet stacking box 9*c* stacks therein determined sheets of any size, which are determined as not being reusable.

The sheet carrying portion 10, which carries determined sheets in the longitudinal direction, corresponding to the sheet stacking portion 9, is disposed inside the case 2. The sheet carrying portion 10 is provided with a first branch carrying portion 10*a* corresponding to the first sheet stacking box 9*a*, and a second branch carrying portion 10*b* corresponding to the second sheet stacking box 9*b*, and the carrying end of the sheet carrying portion 10 corresponds to the third sheet stacking box 9*c*. In addition, a pair of paper feeding rollers 11 is disposed at each of the carrying ends of the first branch carrying portion 10*a*, the second branch carrying portion 10*b*, and the sheet carrying portion 10.

In addition, the sheet carrying portion 10 is provided with sorting devices 12*a* and 12*b* corresponding to the first branch carrying portion 10*a* and the second branch carrying portion 10*b*. When the determined sheet moving along the sheet carrying portion 10 reaches a corresponding sorting device, the corresponding sorting device blocks the carrying path of the sheet carrying portion 10, and forwards the determined sheet to the branch carrying portion. Thereby, the determined sheet is fed to a corresponding sheet stacking box and stacked thereon by the paper feeding roller pair 11.

In this embodiment, the determined sheets determined as being reusable are stacked in the sheet stacking boxes of corresponding sizes by the driving of the first sorting device 12*a* and the second sorting device 12*b*. The determined sheet determined as not being reusable are carried from the carrying end of the sheet carrying portion 10 to the third sheet stacking box 9*c* without the driving of the sorting devices 12*a* and 12*b*.

The case 2 is provided with a display screen, and the instruction portion 14 including operation switches, a control portion, a reusability determination portion, and the like on its upper surface.

The reusability determination portion will be described in detail with reference to FIGS. 2 and 3.

The first reading portion 4 and the second reading portion 5 having the same structure, the same members are given the same reference numerals. In addition, the description of the first reading portion 4 will be made, and the description of the second reading portion 5 will be omitted. In the first reading portion 4, an illumination portion 41 which illuminates a surface of a sheet S and a reference roller 42 which limits a reading position of the sheet S when the surface of the sheet S is read are disposed with a sheet carrying surface L interposed therebetween, and the illumination portion 41 irradiates the surface of the sheet S with illumination light. The light reflected from the surface of the sheet S forms an image on a CCD array 44 which is an imaging portion arranged in the main scanning direction, through an image forming lens 43.

The illumination portion 41 has a configuration in which a line of LED string 51 where a plurality of LEDs (Light Emitting Diodes) 51*a* is arranged in the main scanning direction is arranged on a base member 53 in plurality in the longitudinal direction, and the illumination light is disposed to be tilted with respect to the sheet carrying surface L. A LED group 52 in which the LED strings 51 are arranged in plurality in the longitudinal direction is vertically divided into a first string portion 52*a* including a plurality of LED strings 51 and a second string portion 52*b* including a plurality of LED strings 51. The irradiation angle θ1 of the illumination light from the upper first string portion 52*a* differs from the irradiation angle θ2 of the illumination light from the lower second string portion 52*b*.

The irradiation angle θ1 of the first string portion 52*a* is set to, for example, 45 degrees, and the irradiation angle θ2 of the second string portion 52*b* is set to an angle smaller than 45 degrees, thereby illuminating the surface of the sheet S so as to be parallel to the surface of the sheet S if possible. If wrinkles occur in the surface of the sheet S, the wrinkles generate parts which slightly protrude from the surface of the sheet S, thus when the first string portion 52*a* is turned off and the second string portion 52*b* is turned on, the irradiation light with the low angle from the second string portion 52*b* reaches the wrinkles, thereby forming shades on the surface of the sheet S. The lower the irradiation angle of the irradiation light from the second string portion 52*b* is, the longer the shades are, and thus the shaded parts can be more clearly recognized using the CCD array 44.

In addition, if the illumination light from the first string portion 52*a* is applied to the surface of the sheet S so as to be perpendicular thereto if possible, the surface of the sheet S is illuminated with high luminance, and residual images on the surface can be imaged by the CCD array 44 with high accuracy. However, the illumination light interferes with the light path of the reflected light from the sheet S, and thus the irradiation angle is set to 45 degrees, as an example. However, the illumination portion 41 may be disposed with a high angle to a degree that does not cause the interference with the light path.

In other words, a lighting switching portion 61 switches turned-on states of the first string portion 52*a* and the second string portion 52*b* such that, when residual images are detected from the surface of the sheet S, the first string portion 52*a* of the LED string 52 is turned on, and when appearance defects on the erased sheet are detected, the second string portion 52*b* is turned on.

The instruction portion 14 has a selection portion which selects a first mode in which residues after erasure are detected, a second mode in which appearance defects on the erased sheet are detected, and a third mode in which residual images and appearance defects of the erased sheet are detected, and transmits selection mode information to the lighting switching portion 61 and a sheet carrying control portion 62 which controls sheet carrying. The sheet carrying control portion 62 controls driving of the flapper 13 and the paper feeding rollers according to the selection modes.

Information read by the CCD array 44 is transmitted to a reusability determination portion 63. The reusability determination portion 63 receives information for the detection mode from the instruction portion 14, and determines reusability according to the transmitted mode. In the residues-after-erasure detection which is the first mode, reusability is determined based on image information such as, for example, the size or density of residual images. In addition, in the second mode, reusability is determined based on image information such as a size or a density of shades caused by wrinkles or folded end parts. Further, in the third mode, for example, if the detection results in both of the first and second modes show reusability, reusability is determined.

The CCD array 44 can detect the length of the sheet S to be read in the main scanning direction, and, can detect the length in the carrying detection based on detection of positions of both ends of the sheet S in the carrying direction. A sheet size determination portion 64 determines the size of the sheet S to be read based on the information from the CCD array 44, and transmits the determination result to the sheet carrying control portion 62. In addition, the number of sheets can be counted for each size of the sheet based on information for the determination for the sheet S size.

The sheet carrying control portion 62 drives a sheet carrying device 65 such as the flapper 13, the first sorting device 12*a*, and the second sorting device 12*b* based on the sheet size and reusability determination result. By driving the sheet carrying device 65, sheets determined as being reusable are stacked in the first sheet stacking box 9*a* and the second sheet stacking box 9*b* of corresponding sizes.

In addition, sheets determined as not being reusable are stacked in the third sheet stacking box 9*c*. In addition, sheets for which reusability determination is not completed are carried along the sheet re-carrying path 3.

As such, in this embodiment, after an erasable image is erased from a sheet on which the erasable image is printed, the reusability determination can be automatically performed, and reusable sheets can be sorted and stacked for each size. In addition, in the determination of the presence or absence of residues after the erasure and the determination of presence or absence of wrinkles or folded parts or the like, the irradiation angles of illumination light applied to the sheet surface are made to be different, thereby illumination angles are lowered such that shades caused by the wrinkles becomes long, and therefore it is possible to determine whether or not the wrinkles are present with high accuracy.

Operations of the reusability determination process for the erased sheet and the sorting process for the determined sheet will be described with reference to the flow chart of FIG. 3.

If the operation in this process starts, it is determined whether or not the instruction portion 14 selects the first mode for detecting residues after erasure (ACT 1). If the first mode is selected, the first string portion 52*a* of the LED group 52 is turned on in ACT 2, and illuminates the sheet S at an irradiation angle so as to be close directly thereabove if possible. Light reflected from the sheet S is read by the CCD array 44 (ACT 3), and reusability determination for an erased sheet is determined (ACT 4).

In ACT 4, if the erased sheet is determined as being reusable (Y), the determined sheet is forwarded to the sheet carrying portion 10 side by driving the flapper 13, and is stacked in the reusable sheet stacking boxes 9*a* and 9*b* of corresponding sizes by driving the sorting devices 12*a* and 12*b* of corresponding sheet sizes (ACT 5).

In ACT 4, if the erased sheet is determined as not being reusable (N), the determined sheet is forwarded to the sheet carrying portion 10 side by driving the flapper 13, and the determined sheet is stacked in the non-reusable sheet stacking box 9*c* without driving the sorting devices 12*a* and 12*b* (ACT 6). After the determined sheet is stacked in the stacking box, if this process is continuously performed, the flow returns to ACT 1. In addition, if the reusability determination is consecutively performed for a plurality of erased sheets, the flow goes to ACT 3. If the process does not continue (N), the process is finished.

If the first mode is not selected in ACT 1 (N), it is determined whether or not the second mode for detecting wrinkles or the like is selected in ACT 8. If the second mode is selected (Y), the second string portion 52*b* of the LED group 52 is turned on, and illuminates the sheet S at a small irradiation angle if possible, and the flow goes to ACT 3. In this case, the sheets S with no wrinkles or the like are stacked in the reusable sheet stacking boxes 9*a* and 9*b* in ACT 5, and the sheets S with wrinkles or the like are stacked in the non-reusable sheet stacking box 9*c*.

If the second mode is not selected in ACT 1, it is determined whether or not the third mode for performing both the first and second modes is selected in ACT 10, and if the third mode is not selected (N), the flow returns to ACT 1. In addition, if the third mode is selected (Y), the flow goes to ACT 11, ACT 12, and ACT 13, and the same processes as in ACT 2, ACT 3, and ACT 4 are performed. The determination result in ACT 13 is temporarily stored, and the flow goes to ACT 14.

In ACT 14, the first string portion 52*a* of the LED group 52 is turned off, the second string portion 52*b* is turned on, and the flow goes to ACT 15 and ACT 16 where the same processes as in ACT 2, ACT 3, and ACT 4 are performed. The determination result in ACT 16 is temporarily stored, and the flow goes to ACT 17.

In ACT 17, a comprehensive determination is performed based on the determination results in the first and second modes stored in ACT 13 and ACT 16. In the comprehensive determination in ACT 17, if the determination results in the first and second modes stored in ACT 13 and ACT 16 show reusability of sheets (Y), the flow goes to ACT 5, and if all or either of the determination results show non-reusability of sheets (N), the flow goes to ACT 6.

In addition, if the reusability determination is consecutively performed for a plurality of erased sheets in ACT 8 and ACT 10, the flow goes from ACT 7 to ACT 3 and ACT 12.

In this embodiment, both sides of the sheet S are simultaneously read by the first reading portion 4 and the second reading portion 5, but a single side of the sheet S may be read by either of the reading portions. In addition, a carrying path for reversing a sheet is provided between the sheet carrying portion 10 and the sheet re-carrying path 3, the first surface of the sheet S is read, and then the sheet S is temporarily carried to the sheet carrying portion 10. The sheet on the sheet carrying portion 10 is carried to the sheet re-carrying path 3 via the carrying path for reversing a sheet, and then second surface of the sheet S can be read by the reading portion.

In addition, the number of the determined sheets carried to each of the sheet stacking boxes 9*a*, 9*b* and 9*c* is counted, and thereby a warning may be emitted before reaching the number of sheets at which each sheet stacking box is full.

Second Embodiment

Figure 4:
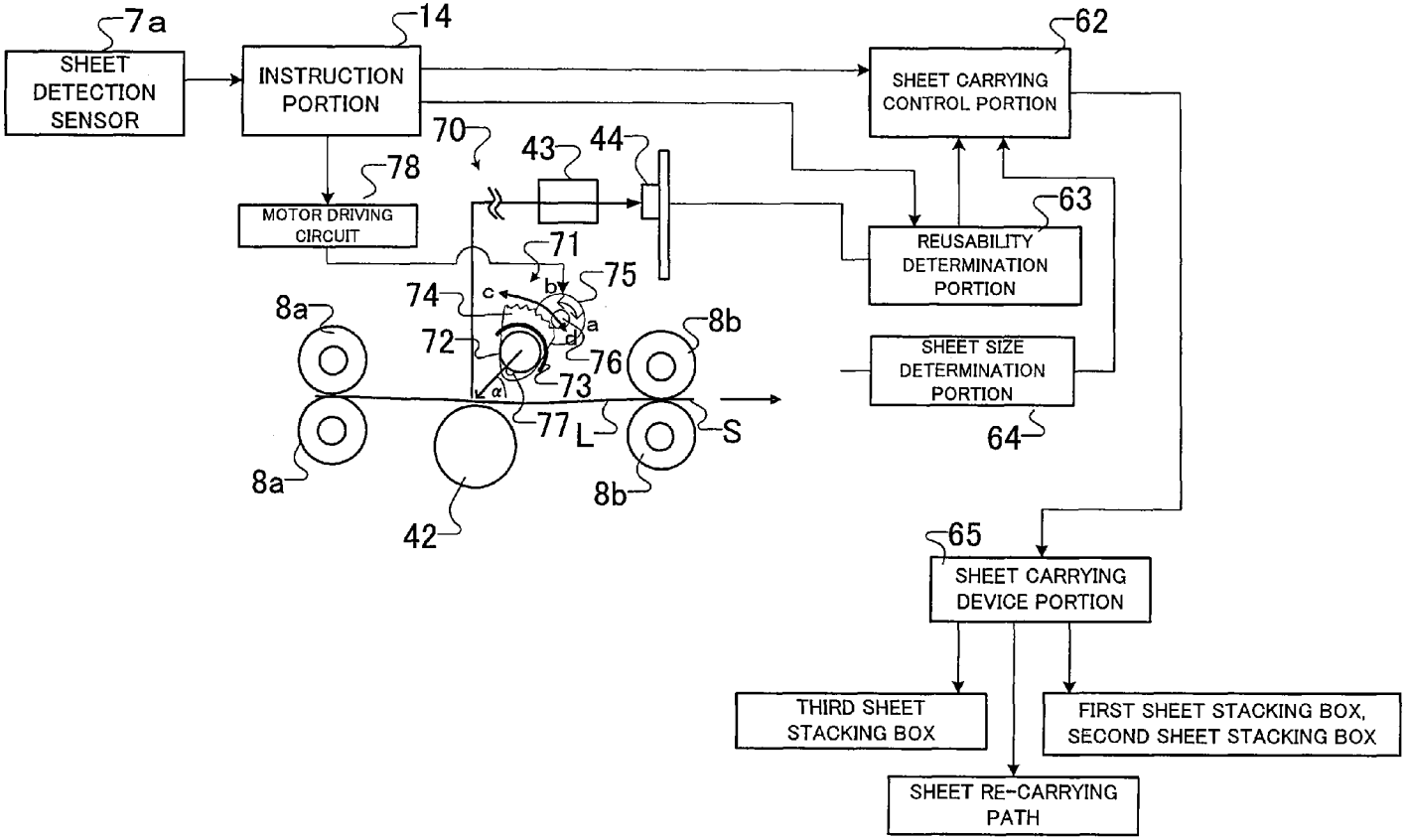
FIG. 4 is a diagram illustrating a structure and a control block of a reusability determination portion according to a second embodiment.

FIG. 4 is a diagram illustrating a structure and a control block of the reusability determination portion according to a second embodiment.

An image reading unit 70 shown in FIG. 4 is different from the embodiment shown in FIG. 2 in a configuration of an illumination portion 71. The illumination portion 71 includes a lamp 72 arranged in the main scanning direction, and has a configuration in which a reflection umbrella 73 of the lamp 72 is installed in a sector gear 74, and a fixed gear 76 in the motor axis of a motor 75 is connected to a gear portion of the sector gear 74. The sector gear 74 rotates with respect to a spindle 77.

A motor driving circuit 78 drives the gear 76 in the direction of the arrow a if the first mode is selected, and if the second mode is selected, drives the gear 76 in the direction of the arrow b. The sector gear 74 rotates in the directions of the arrows c and d via the gear 76 due to the rotation of the motor 75, and the irradiation angle $\alpha$ of the reflected light of the lamp 72 reflected from the reflection umbrella 73 varies. Therefore, the irradiation angle of the illumination light from the lamp 72 with respect to the sheet S can be changed, thereby illuminating the sheet S at a position close to directly above the sheet S if possible and illuminating the sheet S at a position parallel to the sheet S if possible.

Third Embodiment

Figure 5:
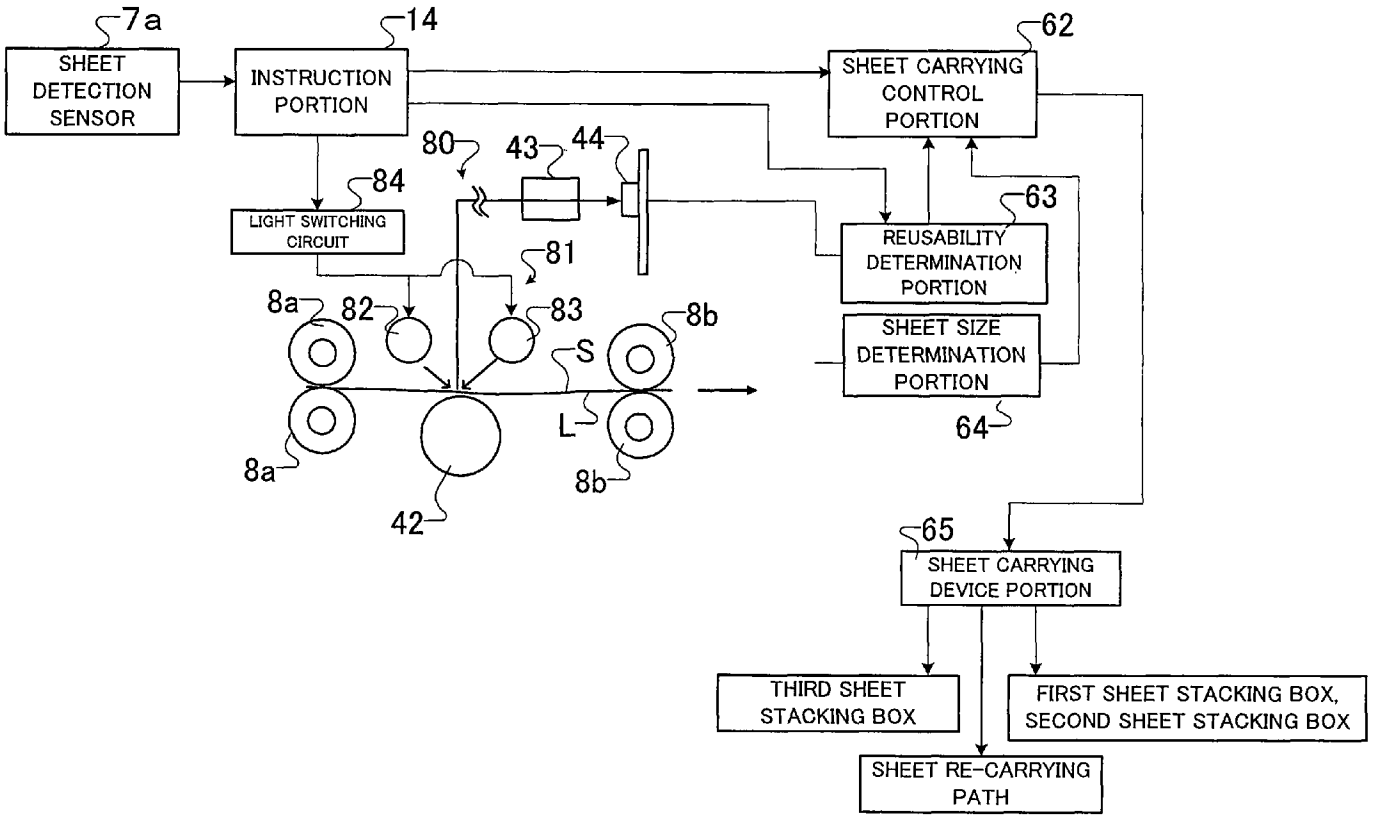
FIG. 5 is a diagram illustrating a structure and a control block of a reusability determination portion according to a third embodiment.

FIG. 5 is a diagram illustrating a structure of a control block of the reusability determination portion according to a third embodiment.

An image reading unit 80 shown in FIG. 5 is different from the embodiment shown in FIG. 2 in a configuration of an illumination portion 81. In the illumination portion 81, a first lamp 82 and a second lamp 83 which are arranged in the main scanning direction are disposed opposite to each other. The first lamp 82 in the upstream side and the second lamp 83 in the downstream side are disposed so as to be symmetric with respect to an image light axis in the upstream side and in the downstream side of the carrying direction. In addition, the first lamp 82 and the second lamp 83 have the irradiation angles of 45 degrees with respect to the carrying surface L and all illuminate the top of the reference roller 42.

The first lamp 82 and the second lamp 83 are respectively turned on and off by a lighting switching circuit 84. If the first mode for detecting residues after erasure is selected, the lighting switching circuit 84 turns on both of the first lamp 82 and the second lamp 83, thereby the surface of the sheet S is applied with light from the upstream side and the downstream side in the carrying direction with the same luminance, and therefore the surface of the sheet S can be imaged without causing shades and a density difference.

In addition, if the second mode for detecting wrinkles or the like is selected, either the first lamp 82 or the second lamp 83 is turned on. Therefore, the illumination light is applied to wrinkles on the sheet S from the lateral side, and thus projected shades can be imaged.

Figure 6:
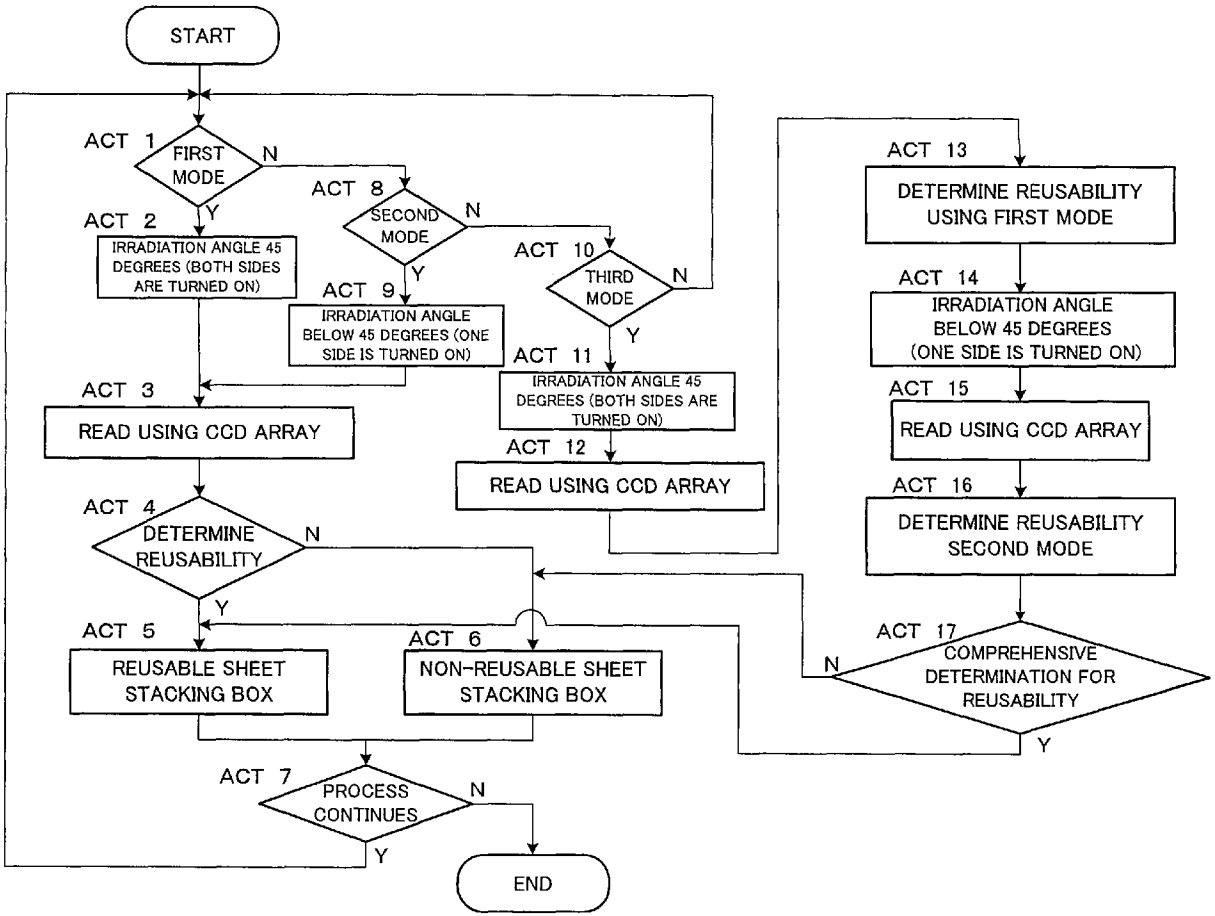
FIG. 6 is a flowchart illustrating an operation of the reusability determination portion according to the second and third embodiment.

FIG. 6 is a flowchart illustrating operations of the reusability determination portion according to the second and third embodiments.

FIG. 6 is different from FIG. 3 in ACT 2, ACT 9, ACT 11, and ACT 14, and other parts are the same. In addition, in the second and third embodiments as well, operations in ACT 2, ACT 9, ACT 11, and ACT 14 are different, and thus these are described.

In the flowchart in FIG. 6, in ACT 2, the irradiation angle is set to 45 degrees by driving the motor in the second embodiment. In addition, in the third embodiment, both the first lamp 82 and the second lamp 83 are turned on. The operation in ACT 11 is the same as in ACT 2.

In ACT 9, the irradiation angle is set to an angle smaller than 45 degrees by driving the motor in the second embodiment. In addition, in the third embodiment, either the first lamp 82 or the second lamp 83 is turned on. The operation in ACT 14 is the same as in ACT 9.

Fourth Embodiment

Figure 7:
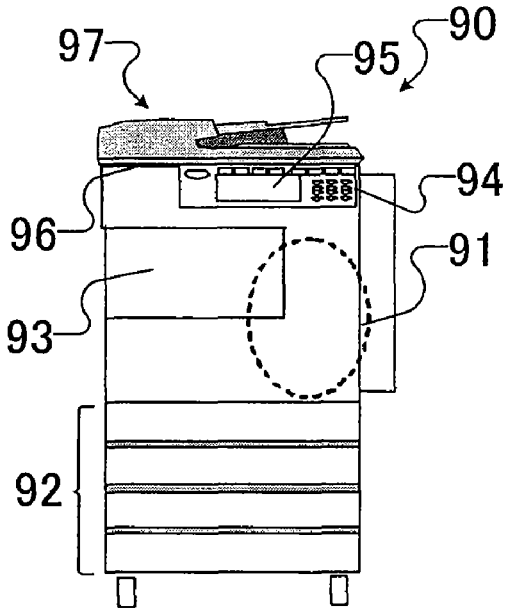
FIG. 7 is the overall configuration diagram illustrating a multi function peripheral according to an embodiment.
Figure 8:
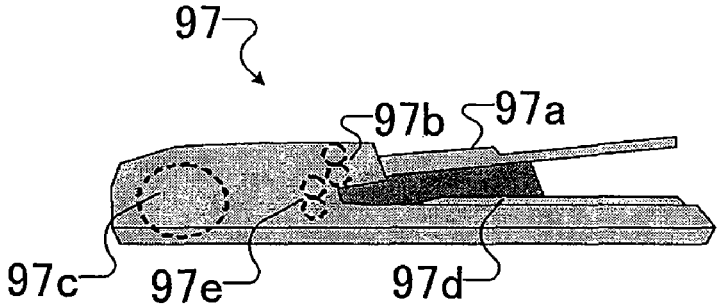
FIG. 8 is a front view illustrating an automatic document feeder in FIG. 7.

FIG. 7 is the overall configuration diagram illustrating an image forming device such as a multi function peripheral (MFP) according to an embodiment, and FIG. 8 is a front view illustrating an automatic document feeder in FIG. 7.

The erased sheet is reused in the image forming device such as an MFP and undergoes printing using erasable toner. The image forming device 90 includes a paper feeding cassette portion 92 which sets sheets and forwards the sheets to a fixing portion 91 which heats and presses the sheets for fixing, a paper discharging portion 93 which discharges a sheet on which an image is formed, an operation portion 94 from which a user selects functions, a display portion 95 which displays selected functions or processed states, and an automatic document feeder (ADF) 97 which carries documents to be copied one by one to a scanner 96, and the scanner portion 96 obtains an image of a document.

The automatic document feeder 97 includes a paper feeding tray 97*a* which sets documents, paper feeding rollers 97*b* which carry a picked-up sheet to the inside, a sheet reversion mechanism 97*c* which reverses front and rear sides of a sheet, a paper discharging tray 97*d* which maintains a scanned sheet, and paper discharging rollers 97*e* which carry a sheet to the paper discharging tray 97*d*.

By using the scanner portion 96 as it is, it is possible to determine reusability according to the flowchart in FIG. 3 or the flowchart in FIG. 6.

In addition, the illumination portion 41 shown in FIG. 2 or the illumination portion 71 shown in FIG. 4 are separately provided and the irradiation angle is changed, and thereby wrinkles or the like may be detected, as well as residues after erasure may be detected.

Furthermore, in a case where a pair of the lamps 82 and 83 can be used as an illumination portion of the scanner portion 96 like the illumination portion 71 shown in FIG. 5, it is possible to perform the detection for residues after erasure and the detection for wrinkles or the like by switching a turned-on state and a turned-off state of the lamps.

The reusability determination portion shown in FIGS. 2, 4 and 5 is provided in the operation portion 94 of the image forming device 90.

If a user selects the sheet reusability determination mode, the scanner portion 96 obtains an image for each of sheets set in the paper feeding tray 97*a* of the automatic document feeder 97, and it is determined whether the erasing process is correctly performed for a sheet in the first mode and whether a sheet is not folded or torn in the second mode. In addition, by using the front and rear sides reversing mechanism 97*c*, it is possible to check both the front and rear sides of a sheet.

A sheet determined as being reusable is discharged to the paper discharging tray 97*d*. A sheet determined as not being reusable is stopped at a position where it can be removed by a user. For example, one end of a sheet may be nipped into the paper feeding rollers 97*b* and the other end may be carried up to the paper feeding tray 97*a*. As another example of stopping, one end of a sheet may be nipped into the paper feeding rollers 97*e* and the other end may be carried to the paper feeding tray 97*d*.

In addition, the display portion 95 performs a display indicating that a non-reusable sheet is detected and removed, and the reusability determination is temporarily stopped. If the non-reusable sheet is removed, the reusability determination is resumed. In addition, a new tray for discharging non-reusable sheets may be provided.

By this configuration, it is possible to determine reusability for a sheet on which an image was erased in the image forming device.

The processes described with reference to FIGS. 3 and 6 may be performed by a CPU for processing internal data executing a program stored in advance in a storage region provided in the erasing device 1 or the image forming device 90. In addition, the program may be downloaded to the erasing device 1 or the image forming device 90 from a network, or the program stored in a computer readable recording medium may be installed in the erasing device 1 or the image forming device 90. The recording medium is enough as long as it stores a program and is readable by a computer. The recording medium may use, for example, a RAM (Random Access Memory), a ROM (Read Only Memory), a DRAM, an SRAM (Static Random Access Memory), a VRAM (Video RAM), or a flash memory.

The invention may have various forms without departing from the spirit thereof or main features. Thus, the above-described embodiments are only examples in all aspects and the invention is not limited to the disclosed embodiments. The scope of the invention is disclosed in the accompanying claims and thus is not restricted by the specification. Further, the accompanying claims and their equivalents are intended to cover various modification, various improvements, alternatives, and changes, which all fall within the scope of the invention.

What is claimed is:

1. A printing sheet reusability determination device comprising:

an image erasing unit that erases an erasable image which is printed on a sheet using an erasable color material;

a sheet carrying path that carries a first state sheet on which the erasable image is printed and a second state sheet passed through the image erasing unit;

an imaging portion that images the second state sheet on the sheet carrying path;

an illumination portion that illuminates the second state sheet on the sheet carrying path at a first irradiation angle when images remaining on the second state sheet are photographed, and at a second irradiation angle smaller than the first irradiation angle when a projected image generated by illuminating the second state sheet is photographed;

an irradiation angle changing portion that changes the first irradiation angle and the second irradiation angle; and a reusability determination portion that determines whether or not to reuse the second state sheet based on imaging information obtained by the imaging of the imaging portion at the first irradiation angle and determines whether or not to reuse the second state sheet based on imaging information obtained by the imaging of the imaging portion at the second irradiation angle.

2. The device according to claim 1, wherein the illumination portion includes a first light source portion disposed with the first irradiation angle and a second light source portion disposed with the second irradiation angle.

3. The device according to claim 1, wherein the illumination portion changes direction of illumination light from a light source and changes an irradiation angle from the first irradiation angle to the second irradiation angle.

4. A printing sheet reusability determination device comprising:

a sheet carrying path that carries a second state sheet obtained by erasing an erasable image from a first state sheet on which the erasable image is printed;

an imaging portion that images the second state sheet on the sheet carrying path;

an illumination portion that has a pair of light sources which is opposite to each other and which is symmetrically disposed with respect to an imaging light axis of the imaging portion and that illuminates the second state sheet on the sheet carrying path;

a lighting switching portion that changes a first turned-on state in which the pair of light sources is all turned on and a second turned-on state in which either of the pair of light sources is turned on; and a reusability determination portion that determines whether or not to reuse the second state sheet based on imaging information obtained by the imaging of the imaging portion with illumination in the first turned-on state, and determines whether or not to reuse the second state sheet based on imaging information obtained by the imaging of the imaging portion with illumination in the second turned-on state.

5. An erasing device comprising:

a sheet carrying path that carries a first state sheet on which an erasable image is printed;

a printing image erasing portion that erases the erasable image on the first state sheet which is carried on the sheet carrying path;

a reading portion that applies illumination light to a surface of a second state sheet obtained by erasing the erasable image from the first state sheet in the printing image erasing portion, in an irradiation state where a projected image is easy to generate and in an irradiation state where the projected image is difficult to generate, and that reads a surface of the second state sheet for each irradiation state using the imaging unit; and a reusability determination portion that determines whether or not to reuse the second state sheet based on an imaging result from the imaging portion according to the irradiation states of the illumination light.

6. The device according to claim 5, wherein the printing image erasing portion and the reading portion are disposed on the sheet carrying path.

7. The device according to claim 5, further comprising a stacking portion that stacks the second state sheet for which reusability is determined.

8. The device according to claim 7, wherein the stacking portion sorts a reusable second state sheet and a non-reusable second state sheet and stacks the sorted second state sheet.

9. The device according to claim 5, wherein the reading unit is disposed at both sides of a sheet carrying surface of the sheet carrying path.

10. An image forming device which reads an original document sent from an automatic document feeder using a scanner portion, and can change an image forming mode in which an image is formed on a sheet based on information for an image read by the scanner portion and a reusability determination mode in which a second state sheet obtained by erasing an erasable image from a first state sheet on which the erasable image is printed is determined for reusability, comprising:

a reusability determination portion that determines whether or not to reuse the second state sheet based on read information for the second state sheet which is read by the scanner portion when the reusability determination mode is selected.

11. The device according to claim 10, wherein the scanner portion applies illumination light to the second state sheet in an irradiation state where a projected image is easy to generate and in an irradiation state where the projected image is difficult to generate, and the reusability is determined according to the irradiation states.

12. The device according to claim 10, wherein the second state sheet is carried from the automatic document feeder to the scanner portion.

13. The device according to claim 10, further comprising a display portion that displays non-reusability if the reusability determination portion determines the second state sheet as being non-reusable, wherein the second state sheet determined as being non-reusable stops being carried in a place where the second state sheet is easily removed.

14. The device according to claim 10, further comprising a tray that discharges the second state sheet determined as being non-reusable by the reusability determination portion.

15. The device according to claim 10, further comprising a sheet reversing mechanism that can automatically reverse front and rear sides of the second state sheet.

16. A printing sheet reusability determination method comprising:

carrying a second state sheet obtained by erasing an erasable image from a first state sheet on which the erasable image is printed on a sheet carrying path;

causing an imaging portion to image the second state sheet on the sheet carrying path;

causing separate illumination means to illuminate the second state sheet on the sheet carrying path at a first irradiation angle when images remaining on the second state sheet are photographed, and at a second irradiation angle smaller than the first irradiation angle when a projected image generated by illuminating the second state sheet is photographed; and determining whether or not to reuse the second state sheet based on imaging information obtained by the imaging of the imaging portion at the first irradiation angle and determining whether or not to reuse the second state sheet based on imaging information obtained by the imaging of the imaging portion at the second irradiation angle.

17. The method according to claim 16, wherein the illumination portion includes a first light source portion disposed with the first irradiation angle and a second light source portion disposed with the second irradiation angle.

18. The method according to claim 16, wherein the illumination portion changes direction of illumination light from a light source and changes an irradiation angle from the first irradiation angle to the second irradiation angle.

19. A printing sheet reusability determination method comprising:

carrying a second state sheet obtained by erasing an erasable image from a first state sheet on which the erasable image is printed on a sheet carrying path;

causing an imaging portion to image the second state sheet on the sheet carrying path;

disposing a pair of light sources which is opposite to each other so as to be symmetric to each other with respect to an imaging light axis of the imaging portion and illuminating the second state sheet on the sheet carrying path by changing a first turned-on state in which the pair of light sources is all turned on and a second turned-on state in which either of the pair of light sources is turned on; and determining whether or not to reuse the second state sheet based on imaging information obtained by the imaging of the imaging portion with illumination in the first turned-on state, and determining whether or not to reuse the second state sheet based on imaging information obtained by the imaging of the imaging portion with illumination in the second turned-on state.

* * * * *